United States Patent [19]

Garrett et al.

[11] Patent Number: 4,550,851

[45] Date of Patent: Nov. 5, 1985

[54] CONTAINER TOP OPENING MEANS

[75] Inventors: Ernest R. Garrett, 17054 Chatsworth St., Granada Hills, Calif. 91344; Charles A. Chambers, Burbank, Calif.

[73] Assignee: Ernest R. Garrett, Granada Hills, Calif.

[21] Appl. No.: 570,974

[22] Filed: Jan. 16, 1984

[51] Int. Cl.[4] ..... B65D 17/42

[52] U.S. Cl. ..... 220/277; 220/270

[58] Field of Search ..... 220/269, 270, 277

[56] References Cited

U.S. PATENT DOCUMENTS

| | | | |
|---|---|---|---|
| 2,870,935 | 1/1959 | Houghtelling | 220/270 |
| 3,250,424 | 5/1966 | Martin | 220/277 |
| 3,826,402 | 7/1974 | Houghen et al. | 220/277 |
| 4,014,455 | 3/1977 | La Croce | 220/271 |
| 4,183,445 | 1/1980 | La Cross | 220/269 |

*Primary Examiner*—George T. Hall

*Attorney, Agent, or Firm*—John E. Wagner

[57] ABSTRACT

An improved container top for beverage container of the pull tab or ring type. The container top includes a generally "smile" shaped opening which is produced by actuation of a pull tab or ring opener. In one embodiment, the ring opener is slidable into a position to sever a smile shaped opening by fracturing at a tear line. In a second embodiment, the ring opener pivots about a rivet integral with the container top to an opening position and then out of the opening area.

8 Claims, 15 Drawing Figures

Fig. 1
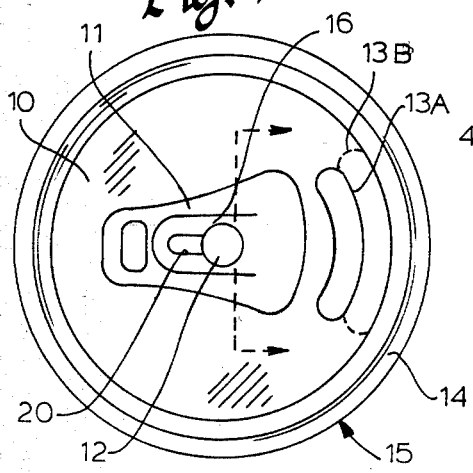
Fig. 2
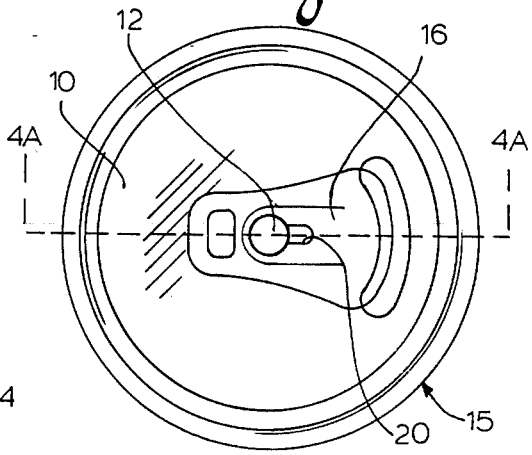
Fig. 3
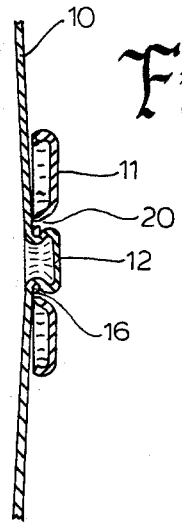
Fig. 4
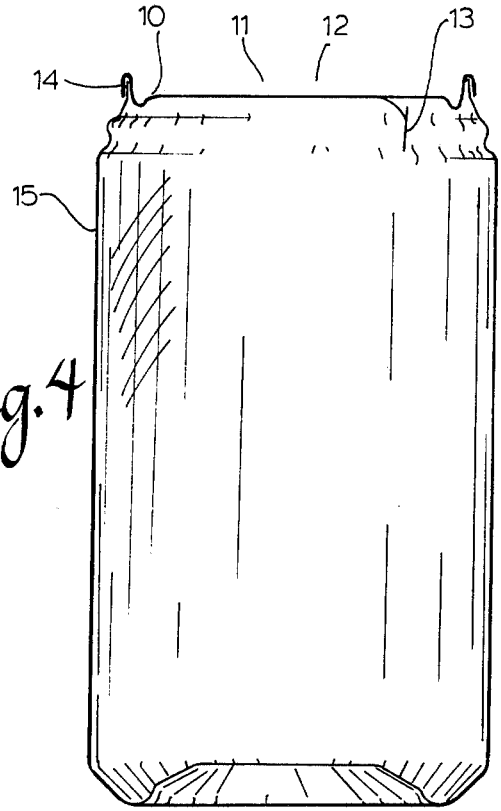
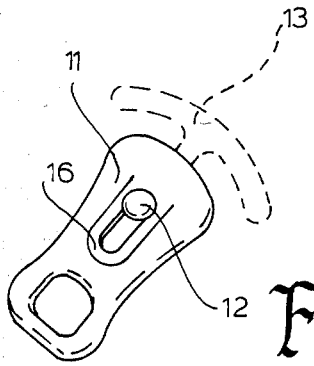
Fig. 5

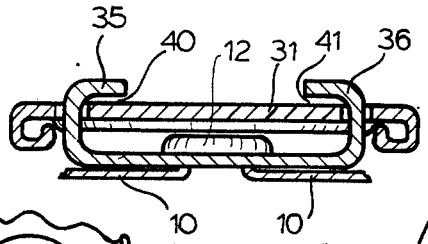
Fig. 6A
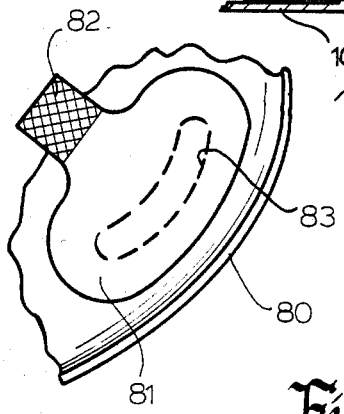
Fig. 13
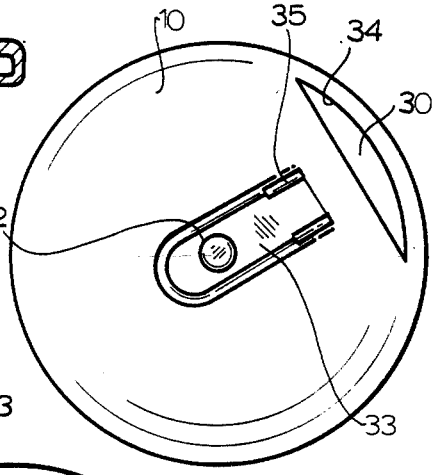
Fig. 7
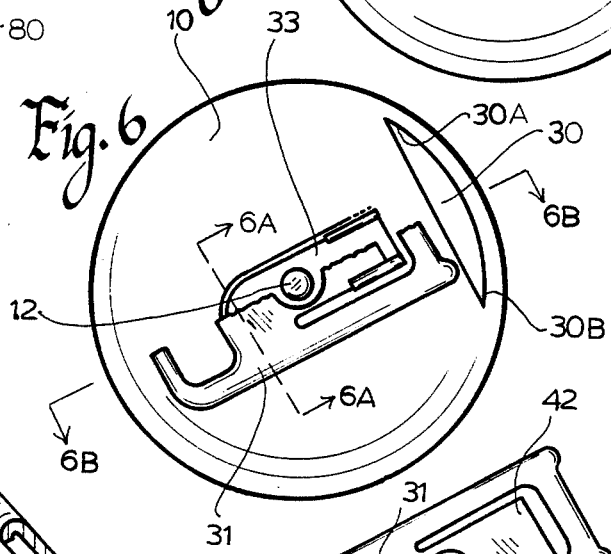
Fig. 6
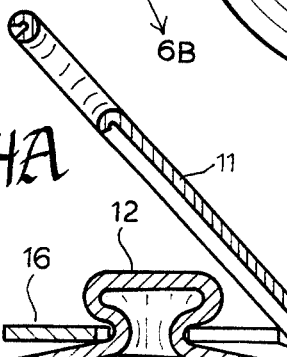
Fig. 4A
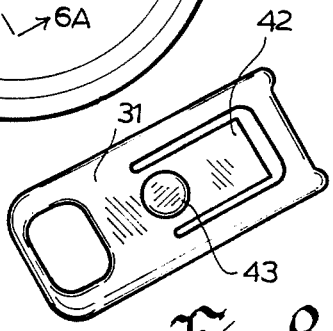
Fig. 8
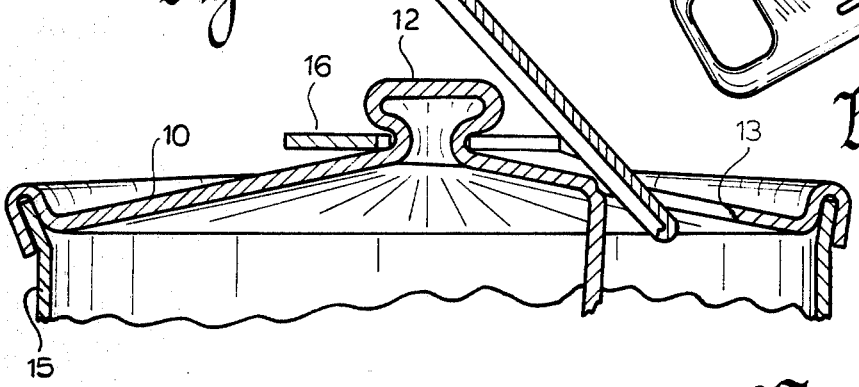
Fig. 12
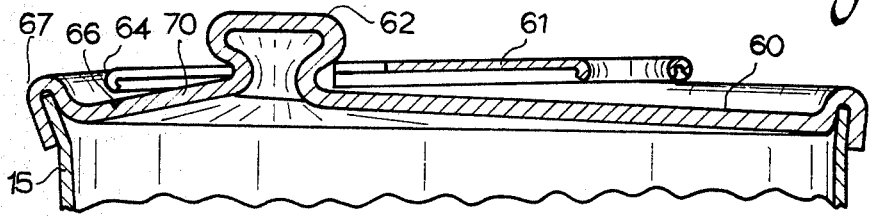

CONTAINER TOP OPENING MEANS

BACKGROUND OF THE INVENTION

Over the last several years significant progress has been made in food or beverage containers having metal tops openable without a separate opener. These are often referred to as ring tab containers since they characteristically have a ring-like metal handle which is secured to the container top by an integral rivet in the top. Usually, the handles are pivotable upward by bending of a central arm secured to the rivet, and by applying localized pressure on a partially die cut section of the container top. The handle partly severs the opening section and allows the opening section to be pivoted inward into the container, leaving an opening for consuming the liquid contents. The ring and opening section remain attached to the top. Typically the openings are pear or radially triangular shaped and are designed to provide a large enough opening for liquid contents to be drunk. In the case of dry foods, the ring not only opens the perforation but is often used to remove the entire central portion of the lid by allowing the user to pull on the ring causing perforation of a spiral path terminating at the rim and the ultimate removal of the container top.

The ring tab containers which I have just described have proven far superior to earlier designs in which the ring and tab were entirely removed from the container. The discarded rings and tabs caused significant environmental pollution and injury.

With the ring and tab remaining as parts of the container, that problem has been eliminated. The tab portion remains within the can out of reach and the ring is folded back into its original position so as to avoid interference with the user when consuming the contents of the can.

In my co-pending application, Ser. No. 569,952, filed Jan. 11, 1984, I have disclosed a new form of container opening for use in disposable plastic covers for beverage containers. Basically, I have discovered that enhanced flavor and convenience for the users is accomplished when the opening in a drink through lid is in the shape of an arc segment or as termed a "smile" extending partially around the periphery of the cup lid. I have found that for both hot and cold liquids for spreading of the beverage into a thin sheet which flows directly over the front part of the tongue provides not only greater convenience for the drinker but also enhanced flavor. Recognizing the physiology of the human mouth and taste buds, this becomes clear that all sweet beverages such as soft drinks are desirably introduced into the front region of the tongue. In the case of hot beverages whether sweet or tart, the spreading of the beverage into a thin sheet prevents scalding of the sensitive taste buds and enhances any sweet flavor present. In my co-pending application I have disclosed and claimed an improved plastic lid having such features.

It was apparent to me that the same principle needed to be applied to containers for beverages other than the plastic disposable cup lids and that ring tab metal containers are suitable for the application for my "smile" opening.

Unfortunately, the formation of a "smile" shaped drinking opening in metal container using a ring tab device is not simply accomplished.

In the prior art, containers having pear or radially triangular shaped openings, the localized pressure applied to the partially die cut part of the container easily severed the remaining thickness and allowed the tab to be opened and folded inward. A thin smile shaped opening was not conducive to even opening by such conventional ring tab designs.

BRIEF DESCRIPTION OF MY INVENTION

Faced with the foregoing state of the art and the need to provide an effective opener for "smile" shaped drinking openings, I recognized that a small shaped opening cannot be opened by severance at a single point or localized as in prior art devices. I need to apply pressure to spaced portions of the smile shaped tab and particularly pressured towards the ends of the smile shaped tab. Since the tab and resulting opening are necessarily small, it meant that the ring, even when pivoted back to its original position parallel to the top of the container top after opening, interfered with drinking out of the "smile" shaped opening. I found it necessary to not only open the top by the application of pressure to spaced points but somehow, without removing the ring totally from the container top, to remove it from interference with drinking. This I accomplished in three ways.

In accordance with one embodiment of this invention, a ring tab is secured to the integral rivet of a container top within an elongated groove which allows the tab limited sliding movement toward and away from the edge of the top. The elongated groove is located in a tongue which is connected toward the front pressure applying portion of the ring tab.

In use, the consumer slides the ring tab forward on the front rivet until it stops, lifts the ring to make the opening, bend the ring back to the horizontal position, and slides it back away from the opening.

In another embodiment of this invention the integral rivet remains generally centrally located in the container top and the ring is made up of two parts. A first part is secured to the integral rivet and has a pair of edges which define a limited length track extending towards the edge of the container top. The ring and tab perforating portion include mating tracks which allow the ring and tab perforating portion to be slid towards the edge of the container top for pivoting and effectively severing the smile shaped opening; for pivoting back to the horizontal and then to be slid towards the center of the container, leaving the smile-shaped opening unobstructed to allow the user to consume the contents.

In accordance with one further embodiment of this invention I devised a generally rectangular shaped ring having two corners positioned over spaced portions of the smile-shaped, partially severed tab so that the pivoting of the ring upward causes severing of the tab at two spaced portions near the ends of the smile shaped opening to ensure that the entire tab is opened all the way at both ends. The ring is secured, as in the case of prior art devices, by an integral rivet in the top. However, the integral rivet is located adjacent to one of the two tab severing corners whereby the ring, after partially severing the tab and bending back to the horizontal, can be pivoted about the integral rivet to pivot the corners out of the smile-shaped opening. This eccentric mounting of the rivet does not interfere with the opening function but allows the ring portion to be totally or nearly completely moved out of the drinking opening so as to avoid any interference.

BRIEF DESCRIPTION OF THE DRAWINGS

My invention may be more clearly understood from the following detailed description and by reference to the drawing in which:

FIG. 1 is a top plan view of one embodiment of my invention incorporated in a beverage container top;

FIG. 2 is a top plan view of the embodiment of FIG. 1 with the ring tab moved into position to open the container;

FIG. 3 is a section through the ring tab of FIG. 1 taken along the line 3—3 of FIG. 1;

FIG. 4 is a vertical diametrical section through the container of FIGS. 1 and 2 after opening;

FIG. 4A is an enlarged fragmentary sectional view of the container and ring tab of FIG. 4. taken along line 4A—4A of FIG. 2;

FIG. 5 is a perspective view of the ring tab of FIGS. 1–4;

FIG. 6 is a top plan view of a first alternate embodiment of this invention with the ring tap longitudinally sectioned;

FIG. 6A is a transverse vertical sectional view of FIG. 6 with the full ring tab shown and taken along line 6A—6A of FIG. 6;

FIG. 6B is a longitudinal vertical sectional view of FIG. 6 taken along line *6b*—*6b* of FIG. 6;

FIG. 7 is a top plan view of the embodiment of FIG. 6 with the ring tab removed;

FIG. 8 is a plan of the ring tab of FIG. 6;

FIG. 12 is a sectional view of the container type of FIG. 9 taken along line 12—12 of FIG. 9;

DETAILED DESCRIPTION OF CAN TOP

Figure 9:
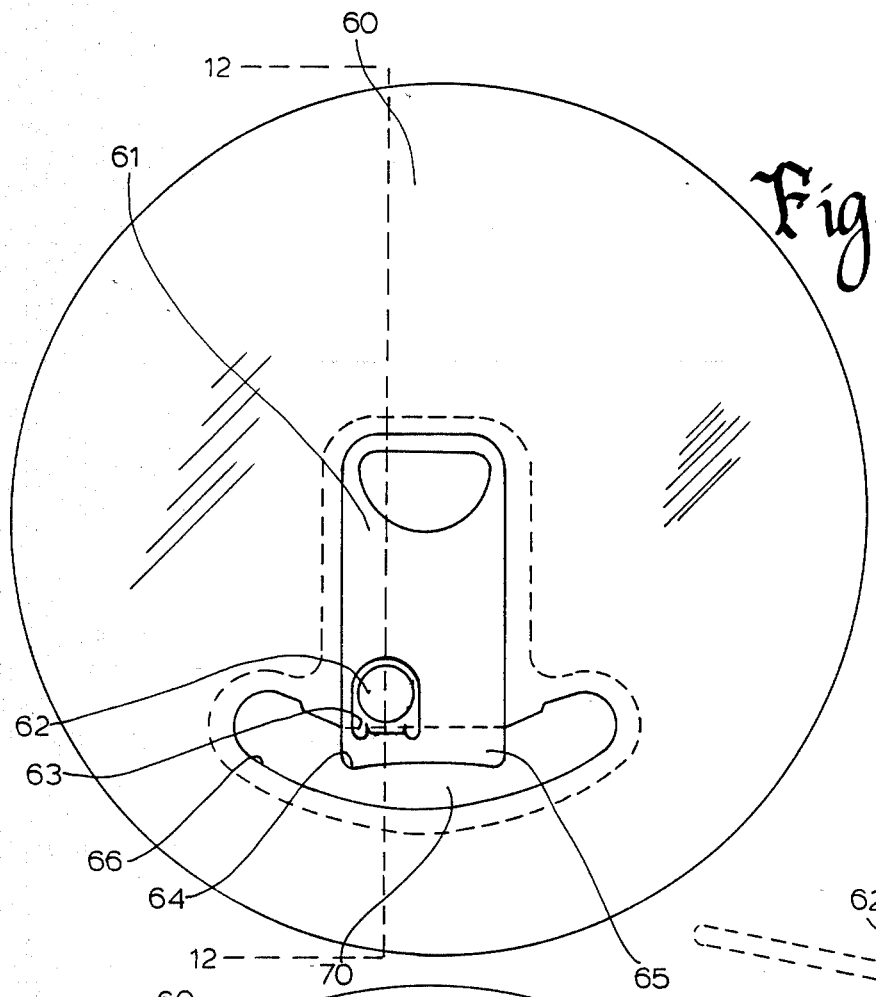
FIG. 9 is a top plan view of a container lid employing a second alternate embodiment of this invention.

Now referring to FIG. 1, the top of a beverage container may be seen fabricated, usually of aluminum or steel, and designed particularly for beverages such as soft drinks and beer. The cover 10 is shown with a ring tab 11 secured at the center of the top 10 by a rivet 12 which is integrally formed in the top 10 and headed over the ring tab 11 to hold it in position. Toward the edge of the top 10 is a smile-shaped partially die cut opening section 13 bounded by the fracture line 13*a* where the smile section 13 separates from the lid 10 in the opening process. The smile section 13 is adjacent to the edge 14 of the top 10 and in fact, may be located immediately adjacent to the edge rim 14 as is denoted by the dashed line 13*b*. In any event, the smile-shaped smile section 13 is adjacent to the edge of the top 10.

The ring tab 11 described above is held in position on the lid 10 by the integral rivet 12. More correctly a tongue 16 of the ring tab 11 is loosely secured to the top 10 by the integral rivet 12. The tongue 16 includes an elongated slot 20 which extends for approximately $\frac{1}{3}$ of the length of ring tab 11 whereby the ring tab 11 may be retracted as it appears in FIG. 1, or advanced whereby the front edge of the ring tab 11 rides over and generally conforms to the shape of the smile section 13.

As may be seen in FIG. 2, the ring tab 11, when moved forward is stopped by the integral rivet 12 when reaching the end of the slot 20.

The details of the arrangement of FIGS. 1 and 2 may be more clearly seen from the sectional views 3 and 4 and respective view 5. In FIG. 3, the integral rivet 12 is shown in detailed section holding the tongue 16 in position. There is sufficient clearance between the shank of the rivet 12 and the tongue 16 to make sliding possible when pressure is applied to the rear or ring portion of the ring tab 11. In operation the tab need be slid forward and lifted to open the smile section 13. The ring tab 11 is slid back away from the smile section 13. After being returned to the horizontal or parallel position with respect to the top 10, the fully opened position for the smile section 13 and retraction of the ring tab 11 is illustrated in FIG. 4. In this case the beverage is ready to be consumed affording the advantages described in my co-pending application referenced above for the smile-shaped opening.

One of the advantages of the ring tab arrangement is that existing machinery for forming the integral rivet 12 and for riveting the ring tab 11 to the container lid can be used without modification. Existing equipment rivets the ring tab to the container with the sufficient degree of freedom whereby the ring tabs maybe rotated about the rivet. The same degree of clearance is sufficient to allow the ring tab to slide as shown in FIGS. 1 and 2. This means that using existing manufacturing equipment, only a new ring tab is required in addition to the smile shape of the opening. The smile section 13 shape is defined by a stamping die which produces a smile-shaped continuous groove in the can lid 10. Typically, the groove is approximately $\frac{1}{2}$ the thickness of the lid 10 whereby the downward pressure applied to the smile section 13 by the front edge of the ring tab 11 is sufficient to fracture the remaining thickness of the lid at the groove line 13*a* to allow its depression into the container. As is illustrated in FIGS. 1, 2, 4 and 5, the smile section 13 is ungrooved at its centermost inner portion whereby it remains secured to the can lid 10 after opening. This insures that the smile-shaped section 13 enters the can, but remains attached to the can lid 10 and may not be ingested by the consumer.

Characteristic of the embodiment of FIG. 1 is that the ring tab is slidable from a retracted position to a position to engage the thin smile section 13 and to effectively depress that smile section 13 and produce the smile-shaped opening.

In accordance with the teaching contained in my co-pending patent application, the smile-shaped opening should have a length "L" and a width "W" in the following range:

"L"=$\frac{1}{2}$" to $1\frac{1}{4}$"

"L"=4 to 8 times "W" (width)

Optimum "L"=5"W"

When the opening meets the above requirement, the liquid contained in the container during the act of drinking is spread out in a thin sheet over the tongue of the drinker, enhancing the contact with the taste buds of the tongue and insures that a larger quantity of the beverage comes in contact with the taste buds, particularly those at the front of the tongue to provide enhanced flavor perception of sweet beverages such as soft drinks. I have also found that the smile-shaped opening, meeting the above criteria, provides a sufficient space to allow the entrance of air into the container allowing a smooth flow outward without the gulping normally associated with consuming a beverage from an existing beverage container having the pear-shaped or radially triangular opening so common today. I find that there is no need for the large central section of the opening. It is thus possible, employing my invention, for one to savor a beverage from a beverage container and obtain enhanced flavor contact with the taste buds and avoid the uncomfortable gulping.

Now referring to FIG. 6, an alternate form of slidable ring tab may be seen, and an alternate form of opening which remains smile-shaped, but in this case is shaped like the segment of the circle. Note in FIG. 6 that the opening 30 ends at points 30*a* and 30*b* which provide cracks for entrance of air while the party is consuming the beverage.

Referring specifically to FIGS. 6*a*, 6*b*, 7 and 8, the ring tab in 31 shown in FIG. 8 is secured, not to the integral rivet 12, but to a track member 33 which is secured relatively rigidly to the top 10 by the integral rivet 12. The assembly including the top 10 of its integral rivet 12 track member 33 and the groove line 34 defining the segment opening 30 and may all be seen in FIG. 7. The track member 33 includes a pair of upstanding rails 35 and 36 best seen in FIG. 6*a*. The upstanding rails 35 and 36 define respective grooves 40 and 41 in which a tongue member 42 of the ring tab 31 rides as the tab 31 is slid forward to open the drinking opening 30 and reverse to clear the tab 31 from interference with the thin opening 30. It should be noted that the ring tab 31 rides over the top of the integral rivet 12 and includes an opening 43 large enough to allow access to the rivet 12 during the heading process. The ring tab 31 and track member 33 are preassembled and placed over the partly formed rivet 12 before it is headed.

The embodiment of FIGS. 6 through 8 has the advantage similar to that of embodiments 1 through 5 in that existing rivet forming dies used in the making of container lids today may be used with this invention merely by placing the track member 33 assembled on the ring tab 31 over the partially formed rivet 12 prior to staking. In these cases the existing tooling for placing an integral rivet in the center of the top 10 may be used.

Figure 10:
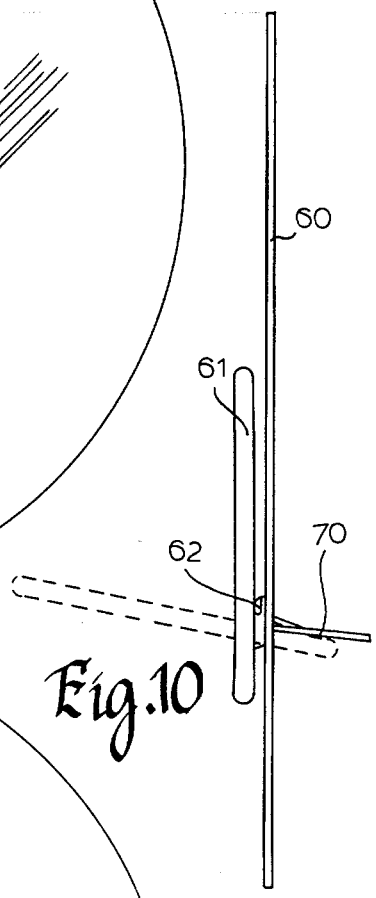
FIG. 10 is an edge view of the container top of FIG. 9 during opening.
Figure 11:
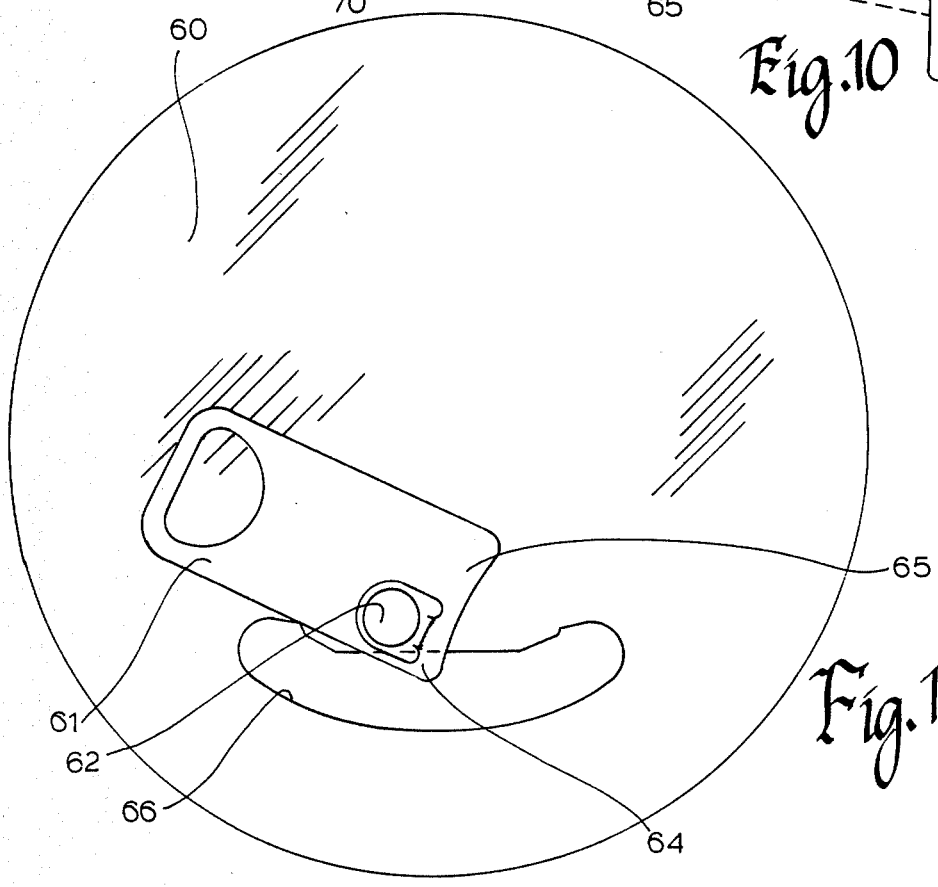
FIG. 11 is a top plan view of the container top of FIG. 9 after opening with the ring tab rotated to one side.

Now refer to FIGS. 9 through 12 for a third embodiment of this invention which is also designed to open a smile-shaped opening in the lid 60 of the container. In this case, the ring tab 61 is secured by an integral rivet 62 located, not at the center of the top 60 but adjacent to the opening 70 and its partially die cut line 66. The ring tab 61 includes an integral tongue 63 secured by the integral rivet 62, a part of the top 60. The ring tab 61 includes a pair of corners 64 and 65 at the front end which served to apply pressure to the opening 70 at two spaced positions. This is desirable in order to effectively open the smile shaped opening 70. In accordance with this embodiment, the ring tab 61 merely is lifted upward whereby it bends about the integral tongue 63 and corner points 64 and 65 depress the opening 70 in manner as illustrated in FIG. 10. Thereafter the ring tab 61 is again returned to the position parallel to the top 60 and pivoted as illustrated in FIG. 11 out of the way to avoid interference with the consumption of the beverage contained within the container. Note that in FIGS. 9–11 the opening 70 appears to be a greater distance from the edge of the top 60 than the comparable openings in FIGS. 1 and 6. This may be explained by the fact that FIGS. 9–11 of the invention are illustrated as a part of a top blank 60 which is yet to have its edge ring formed. Reference should be made to FIG. 12 of the finished form of the top 60 including the edge rim 67. In FIG. 12, the off center location of integral rivet of 62 is apparent. Likewise the position of corner of 64 over the die cut top opening 70 with its severance groove 66 may be seen.

From review of the above three embodiments, it may be seen that by employing this invention a thin smile-shaped opening may be produced around the periphery of a beverage container. After the opening is made the ring tab which makes the opening is removable from the end opening so is not to interfere with consumption of beverage.

I claim:

1. A container top and consumer removable seal for beverage containers comprising: a container top including an arcuate shaped opening in the peripheral region thereof between a pair of parallel arcuate edges defining a relatively uniform width beverage opening, said container top being in substantially permanent sealed relationship with the container; and removable means for closing said arcuate shaped opening;

said arcuate shaped opening having a length of between $\frac{1}{2}$ and $1\frac{1}{4}$ inch in length and in the order of 5 times the width thereof;

whereby said arcuate shaped opening provides a thin sheet of beverage to the mouth and tongue of the person consuming a beverage from the container and provision for entrance of air into the container during drinking of the beverage; and wherein the tongue of the consumer is exposed to minimum temperature extremes from the beverage contained in the container thereby avoiding desensitizing the taste buds on the tongue.

2. The combination in accordance with claim 1 wherein said removable means for closing said arcuate shaped opening comprises an integral scored portion of the container top.

3. The combination in accordance with claim 1 wherein said removable means comprises a cover adhesively secured to said container top.

4. The combination in accordance with claim 1 wherein the length of said arcuate opening is between in the order of 4 to 8 times the width thereof.

5. A beverage container having a top of the type including a ring tab secured to the top by an integral rivet and a score line defining an opening for the consumption of the contents of the container in which a portion of the container top to at least partial severence from the remainder of the container upon localized pressure applied to the top within the score line by pivoting of the ring tab thereagainst in which the scored portion remains attached to the container and the ring tab may be bent back against the container top without interference with the consumption of fluids from the container, the improvement wherein said score line defines an arcuate shape having a length in the order of 5 times or greater than its width and located in the peripheral area of said container top when a part of the container whereby a thin arcuate opening is produced near the periphery of said top when opened;

wherein said ring tab includes an end portion adjacent to said score line of width sufficient to extend over the major portion of the length of said arcuate shape whereby said end portion engages said score line over a major portion of the length thereof to insure the opening of said arcuate shape throughout its length.

6. The combination in accordance with claim 5 wherein the end portion of said ring tab is generally rectangular with two corners positionable at spaced positions along the length of said arcuate shaped score line whereby the pivoting of said ring tab brings the corners of said end portion into engagement with the arcuate score line at two spaced points and whereby the application of pressure on the portion of said top within said score line at the two spaced points insures fracturing of the score line from end to end of said arcuate shape.

7. The combination in accordance with claim 5 wherein said ring tab is secured to said integral rivet assymmetrically whereby a pivoting of said ring tab generally in the plane of the top causes the end portion adjacent to said score line to pivot into and out of the region defined by said score line, whereby said ring tab may be pivoted generally in the plane of the top to place the end portion overlying a substantial portion of the length of said arcuate shape, said ring tab may be pivoted generally normal to the plane of the container top to fracture said score line over a major portion of its length insuring opening of said arcuate shape, and wherein said ring tab may be returned to generally the plane of the container top and pivoted about said integral rivet substantially completely out of the resultant arcuate opening.

8. The combination in accordance with claim 5 wherein said ring tab is in slidable engagement with said top from a position substantially overlying a major portion of the length of said arcuate shape to a position withdrawn from said score line whereby said ring tab is operative to open said arcuate shape upon pivoting generally normal to the plane of said top and withdrawal from said arcuate opening upon pivoting back generally parallel to the plane of the top and sliding away from said arcuate opening.

* * * * *